US011583159B1

(12) United States Patent
Slessor

(10) Patent No.: US 11,583,159 B1
(45) Date of Patent: Feb. 21, 2023

(54) SURFACE CLEANING DEVICE

(71) Applicant: Sandra Slessor, Nestleton Station (CA)

(72) Inventor: Sandra Slessor, Nestleton Station (CA)

( * ) Notice: Subject to any disclaimer, the term of this patent is extended or adjusted under 35 U.S.C. 154(b) by 0 days.

(21) Appl. No.: 17/400,307

(22) Filed: Aug. 12, 2021

(51) Int. Cl.

| | |
|---|---|
| ***A47L 13/22*** | (2006.01) |
| ***A47L 13/254*** | (2006.01) |
| ***A46B 11/00*** | (2006.01) |
| *A47L 13/257* | (2006.01) |

(52) U.S. Cl.
CPC ..... *A47L 13/22* (2013.01); *A46B 11/00* (2013.01); *A46B 11/002* (2013.01); *A46B 11/0065* (2013.01); *A47L 13/254* (2013.01); *A47L 13/257* (2013.01)

(58) Field of Classification Search
CPC ..... F16K 31/122; A47L 13/22; A47L 13/254; A47L 13/20; A47L 13/255; A47L 13/256; A47L 13/257; A47L 13/258; A46B 11/00; A46B 11/002; A46B 11/0065
See application file for complete search history.

(56) References Cited

U.S. PATENT DOCUMENTS

| | | | | |
|---|---|---|---|---|
| 1,033,222 | A * | 7/1912 | Whitehead | A47L 13/22 401/137 |
| 2,470,837 | A * | 5/1949 | Polson | A47L 13/312 401/138 |
| 4,793,646 | A * | 12/1988 | Michaud, Jr. | B63B 21/54 114/221 R |
| 5,364,198 | A | 11/1994 | Skenderi | |
| D444,928 | S | 7/2001 | Bruggeman | |
| 9,149,164 | B2 | 10/2015 | Giustetto | |
| 10,070,766 | B2 | 9/2018 | Patterson | |
| 2005/0095053 | A1* | 5/2005 | Harris | A47L 13/22 401/138 |
| 2005/0271457 | A1* | 12/2005 | Suda | A47L 13/22 401/138 |

FOREIGN PATENT DOCUMENTS

| | | |
|---|---|---|
| WO | WO2017181706 | 10/2017 |

* cited by examiner

*Primary Examiner* — David J Walczak

(57) ABSTRACT

A surface cleaning device for cleaning substantially vertical surfaces includes a plate, which is pivotally engaged to a first end of a rod so that the rod extends from a first face of the plate. The plate has a second face to which a pad can be removably engaged. A canister containing a cleaning solution under pressure engageable to a valve engaged to the plate. A plurality of nozzles is engaged to the first face of the plate and is operationally engaged to and in fluidic communication with the valve. The nozzles can spray the cleaning solution past a leading edge of the plate. An actuator is engaged to the rod proximate its second end and is operationally engaged to the valve. The actuator selectively actuates the valve to dispense the cleaning solution through the nozzles onto a substantially vertical surface proximate to the leading edge of the plate.

9 Claims, 5 Drawing Sheets

SURFACE CLEANING DEVICE

BACKGROUND OF THE INVENTION

(1) Field of the Invention

The disclosure relates to cleaning devices and more particularly pertains to a new cleaning device for cleaning substantially vertical surfaces. The present invention discloses a cleaning device comprising a rod pivotally engaged to a plate. A canister of cleaning solution and a pad are selectively engageable to opposed sides of the plate. An actuator disposed on the rod distal from the plate actuate a valve to which the canister is engaged to direct the cleaning solution through nozzles and past a leading edge of the plate.

(2) Description of Related Art Including Information Disclosed Under 37 CFR 1.97 and 1.98

The prior art relates to cleaning devices, which generally comprise rods having cleaning heads or squeegees disposed at one end and reservoirs on the other end, with pumping means provided to direct a spray of cleaning solutions from the reservoir perpendicularly from the cleaning heads or squeegees. What is lacking in the prior art is a cleaning device comprising a canister disposed on the cleaning head, wherein a spray is directed substantially parallel to the cleaning head.

BRIEF SUMMARY OF THE INVENTION

An embodiment of the disclosure meets the needs presented above by generally comprising a plate, which is pivotally engaged to a first end of a rod so that the rod extends from a first face of the plate. The plate has a second face, which is configured to selectively engage a pad so that the pad is removably engaged to the plate. A valve is engaged to the plate and is configured to selectively engage a canister containing a cleaning solution under pressure so that the canister is in fluidic communication with the valve. A plurality of nozzles is engaged to the first face of the plate and is operationally engaged to the valve so that the nozzles are in fluidic communication with the valve. The nozzles are configured to spray the cleaning solution past a leading edge of the plate. An actuator is engaged to the rod proximate to a second end of the rod and is operationally engaged to the valve. The actuator is positioned to selectively actuate the valve to dispense the cleaning solution through the nozzles onto a substantially vertical surface proximate to the leading edge of the plate.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
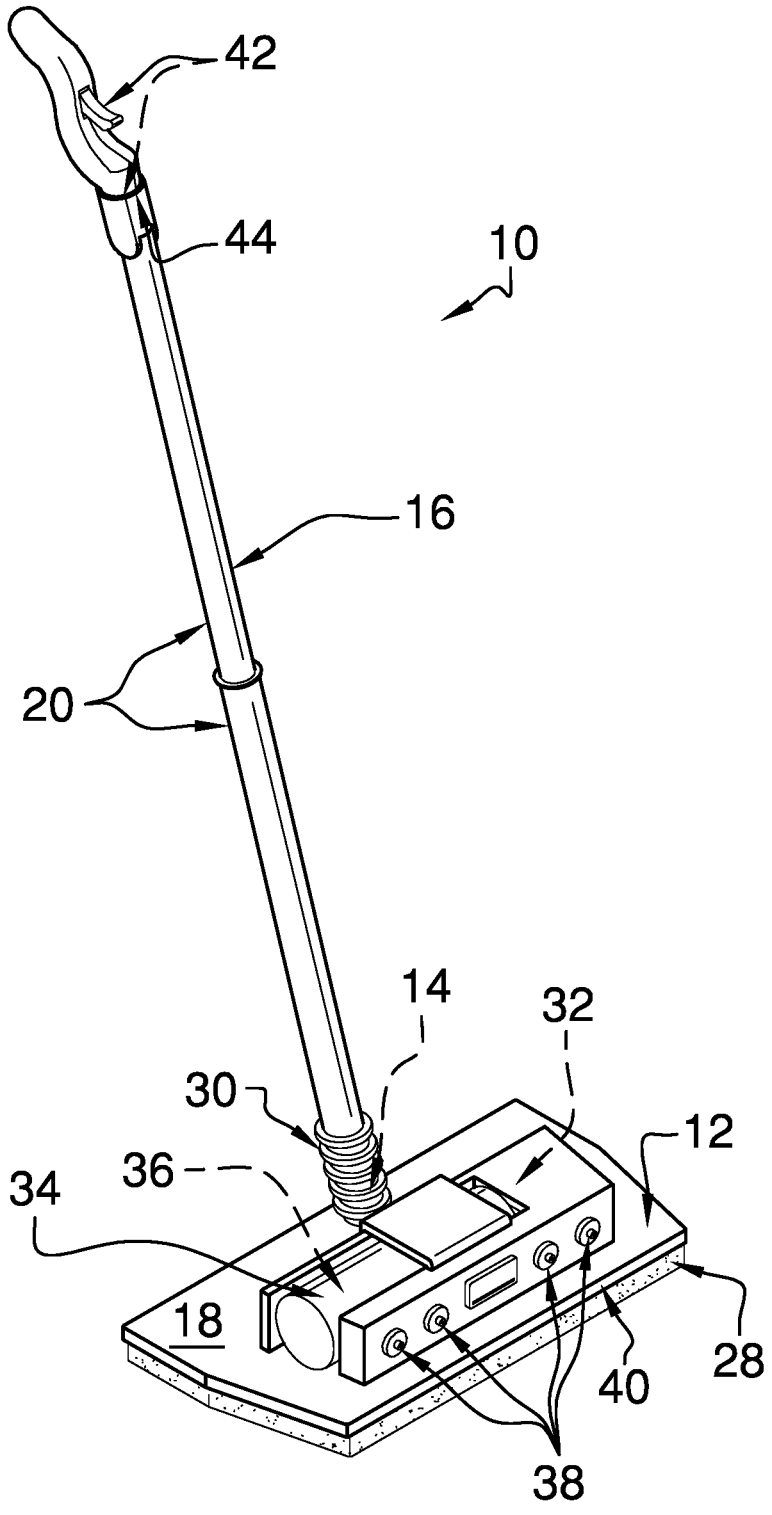
FIG. 1 is an isometric perspective view of a surface cleaning device according to an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

Figure 2:
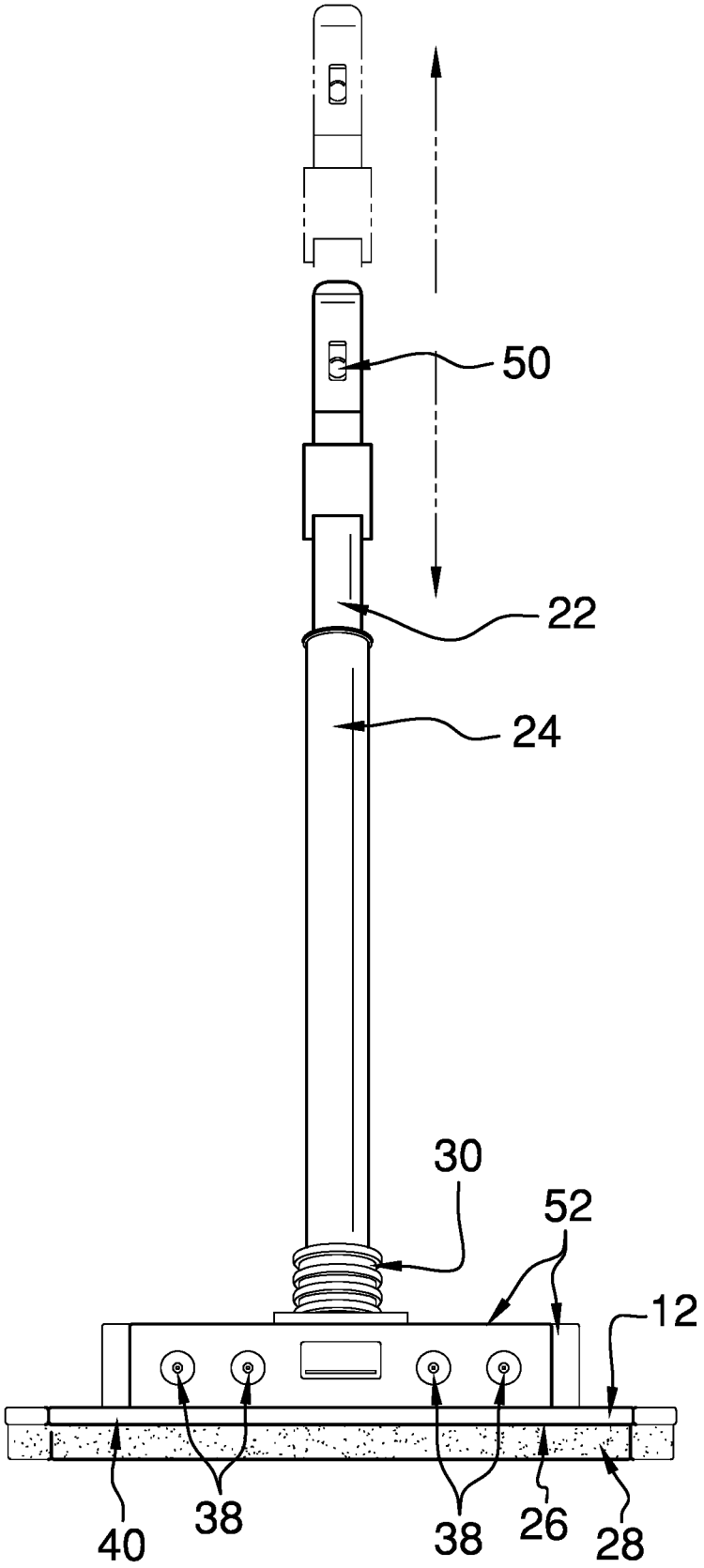
FIG. 2 is a front view of an embodiment of the disclosure.
Figure 3:
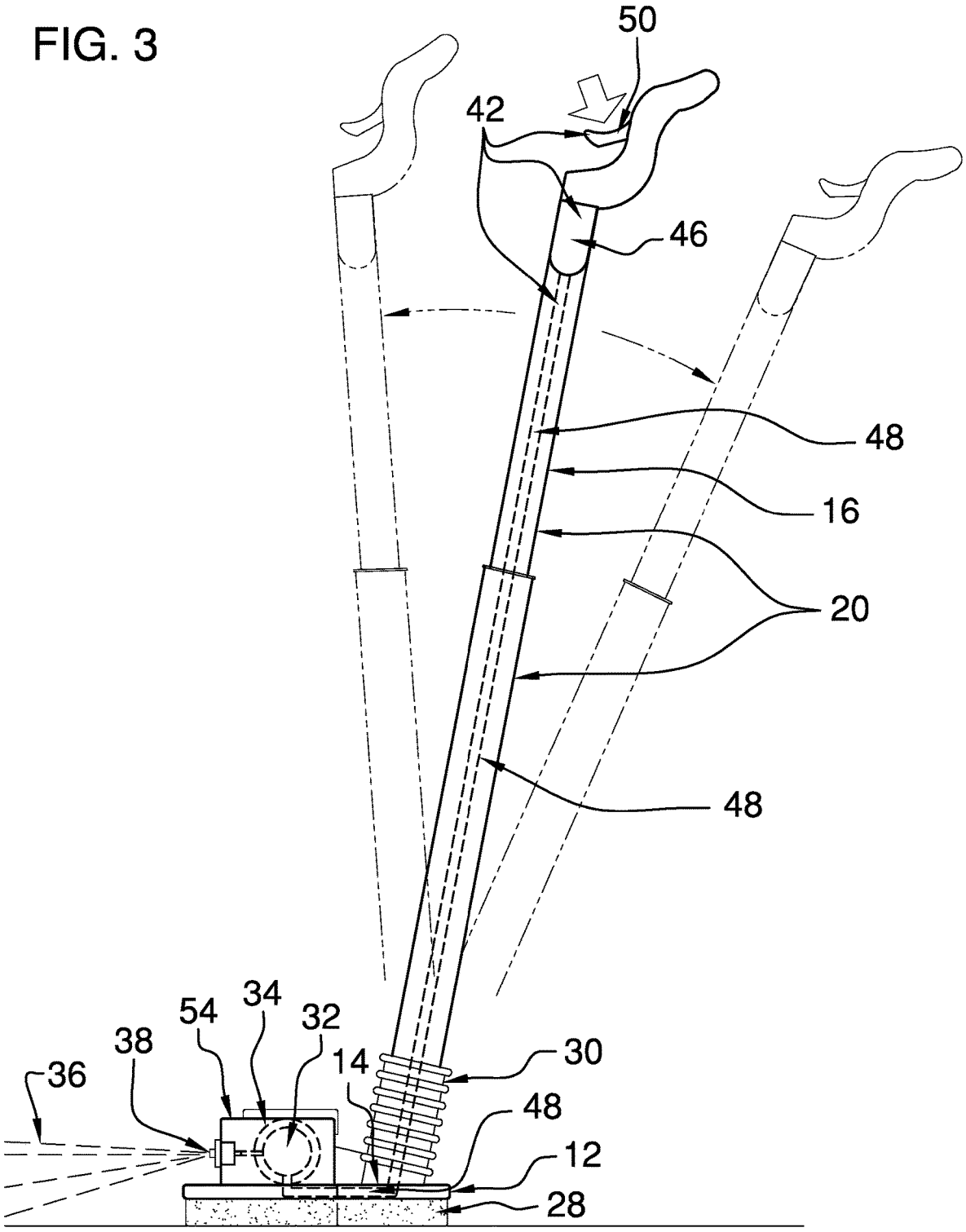
FIG. 3 is a side view of an embodiment of the disclosure.
Figure 4:
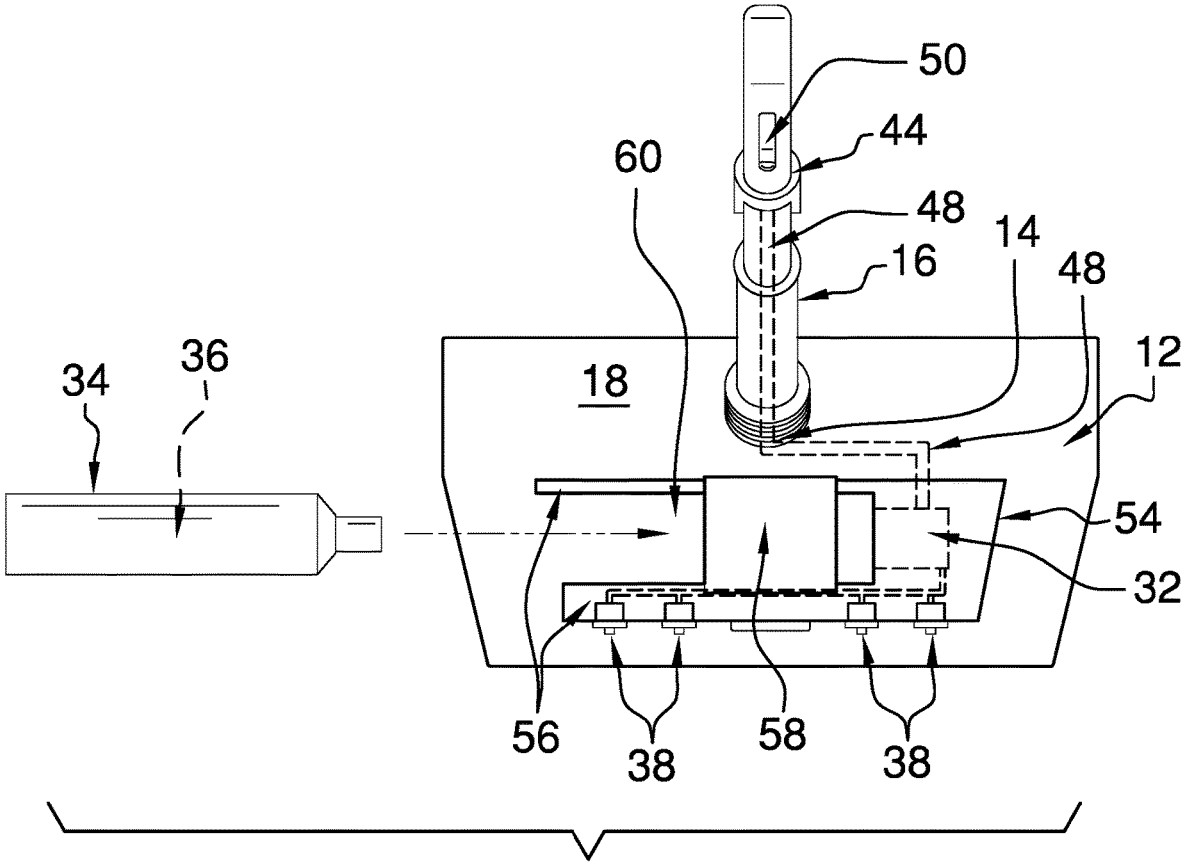
FIG. 4 is a top view of an embodiment of the disclosure.
Figure 5:
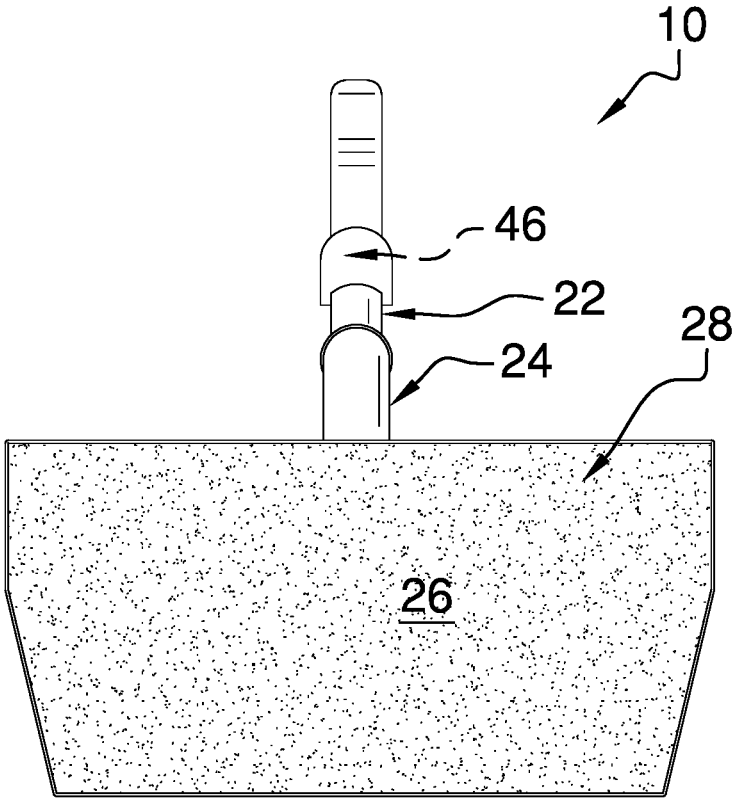
FIG. 5 is a bottom view of an embodiment of the disclosure.

As best illustrated in FIGS. 1 through 5, the surface cleaning device 10 generally comprises a plate 12, which is pivotally engaged to a first end 14 of a rod 16 so that the rod 16 extends from a first face 18 of the plate 12. The rod 16 comprises a plurality of nested sections 20 so that the rod 16 is selectively extensible. The plurality of nested sections 20 may comprise a first section 22 and a second section 24, as shown in FIG. 2, with the first section 22 being selectively extensible from the second section 24. The rod 16 is tubular.

The plate 12 has a second face 26, which is configured to selectively engage a pad 28 so that the pad 28 is removably engaged to the plate 12. Various attachment means for attaching the pad 28 to the plate 12 are anticipated by the present invention, such as, but not limited to, hook and loop fasteners, clips, pressure sensitive adhesives, and the like. Different types of pads 28 are anticipated by the present invention, such as, but not limited to, scouring pads, polishing pads, cloth pads, sponge pads, microfiber pads, and the like.

A connector 30 is engaged to and extends between the rod 16 and the plate 12. The connector 30 is resiliently flexible so that the plate 12 is pivotable relative to the rod 16. The connector 30 comprises one or more of rubber, silicone, and elastomer. The present invention anticipates the connector 30 comprising other connecting means which allow pivoting of the plate 12 relative to the rod 16, such as, but not limited to, ball and socket connections, dual hinge connections, and the like.

A valve 32 is engaged to the plate 12 and is configured to selectively engage a canister 34 containing a cleaning solution 36 under pressure so that the canister 34 is in fluidic communication with the valve 32. The valve 32 may be air actuated. The cleaning solution 36 may be intended for a variety of purposes, such as scouring shower surfaces, polishing wood surfaces, cleaning glass surfaces, and the like.

A plurality of nozzles 38 is engaged to the first face 18 of the plate 12 and is operationally engaged to the valve 32 so that the nozzles 38 are in fluidic communication with the valve 32. The nozzles 38 are configured to spray the cleaning solution 36 past a leading edge 40 of the plate 12. The plurality of nozzles 38 may comprise four nozzles 38, as shown in FIG. 2, or other number of nozzles 38, such as, but not limited to, two nozzles 38, three nozzles 38, or five nozzles 38.

An actuator 42 is engaged to the rod 16 proximate to a second end 44 of the rod 16 and is operationally engaged to the valve 32. The actuator 42 is positioned to selectively actuate the valve 32 to dispense the cleaning solution 36 through the nozzles 38 onto a substantially vertical surface proximate to the leading edge 40 of the plate 12.

The actuator 42 may comprise a piston 46, a tube 48, and a trigger 50. The piston 46 is positioned in the rod 16 proximate to the second end 44. The tube 48 is engaged to and extends between the piston 46 and the valve 32 so that the piston 46 is operationally engaged to the valve 32. The trigger 50 is hingedly engaged to the rod 16 proximate to the second end 44 and is operationally engaged to the piston 46. The trigger 50 is configured to be hinged to increase a pressure within the tube 48 to actuate the valve 32 to dispense the cleaning solution 36 through the nozzles 38 onto the substantially vertical surface proximate to the leading edge 40 of the plate 12. The present invention also anticipates the actuator 42 comprising other actuating means, such as, but not limited to, electrical switches, levers, and the like.

A bracket 52 is engaged to the first face 18 of the plate 12 and is configured to engage the canister 34 so that the canister 34 is removably engaged to the plate 12 and is operationally engaged to the valve 32. The bracket 52 comprises a housing 54, in which the valve 32 is positioned. A pair of first slats 56 is engaged to and extends in parallel from the housing 54. The first slats 56 are engaged to the plate 12 and are parallel to the leading edge 40 of the plate 12. The nozzles 38 are engaged to a respective first slat 56 positioned proximate to the leading edge 40 of the plate 12. A second slat 58 is engaged to and extends between the first slats 56 distal from the plate 12 so that the first slats 56, the second slat 58, and the plate 12 define a cavity 60 configured for insertion of the canister 34. The present invention anticipates the bracket 52 having other structures which are configured to engage a canister 34. The present invention also anticipates a refillable reservoir (not shown), in place of the canister 34, and a pump (not shown), which would be actuated by the actuator 42 to pressurize and pump the cleaning solution 36 through the nozzles 38.

In use, a canister 34 is slid into the cavity 60 so that it engages the valve 32 and is held in place by the bracket 52. A pad 28 appropriate for a particular cleaning task is affixed to the second face 26 of the plate 12. A user grasps the rod 16 while placing a finger on the trigger 50. The pad 28 is positioned on a substantially vertical surface and the trigger 50 is hinged to actuate the valve 32. Cleaning solution 36 from the canister 34 is sprayed through the nozzles 38 past the leading edge 40 of the plate 12, positioning the user for manipulating the rod 16 to motivate the pad 28 through the cleaning solution 36 and across the substantially vertical surface to clean the substantially vertical surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A surface cleaning device comprising:

a rod;

a plate pivotally engaged to a first end of the rod, such that the rod extends from a first face of the plate, the plate having a second face for selectively engaging a pad, such that the pad is removably engaged to the plate;

a valve engaged to the plate and being for selectively engaging a canister containing a cleaning solution under pressure, such that the canister is in fluidic communication with the valve;

a plurality of nozzles engaged to the first face of the plate and being operationally engaged to the valve, such that the nozzles are in fluidic communication with the valve, wherein the nozzles are configured for spraying the cleaning solution past a leading edge of the plate;

an actuator engaged to the rod proximate to a second end of the rod and being operationally engaged to the valve, such that the actuator is positioned for selectively actuating the valve for dispensing the cleaning solution through the nozzles onto a substantially vertical surface proximate to the leading edge of the plate;

wherein the rod is tubular;

wherein the valve is air actuated; and wherein the actuator comprises;

a piston positioned in the rod proximate to the second end, a tube engaged to and extending between the piston and the valve, such that the piston is operationally engaged to the valve, and a trigger hingedly engaged to the rod proximate to the second end and being operationally engaged to the piston, wherein the trigger is configured for hinging for increasing a pressure within the tube for actuating the valve for dispensing the cleaning solution through the nozzles onto the substantially vertical surface proximate to the leading edge of the plate.

2. The surface cleaning device of claim 1, wherein the rod comprises a plurality of nested sections, such that the rod is selectively extensible.

3. The surface cleaning device of claim 2, wherein the plurality of nested sections comprises a first section and a second section, the first section being selectively extensible from the second section.

4. The surface cleaning device of claim 1, further including a connector engaged to and extending between the rod and the plate, the connector being resiliently flexible, such that the plate is pivotable relative to the rod.

5. The surface cleaning device of claim 4, wherein the connector comprises one or more of rubber, silicone, and elastomer.

6. The surface cleaning device of claim 1, wherein the plurality of nozzles comprises four nozzles.

7. The surface cleaning device of claim 1, further including a bracket engaged to the first face of the plate and being configured for engaging the canister, such that the canister is removably engaged to the plate and operationally engaged to the valve.

8. A surface cleaning device comprising:

a rod;

a plate pivotally engaged to a first end of the rod, such that the rod extends from a first face of the plate, the plate having a second face for selectively engaging a pad, such that the pad is removably engaged to the plate;

a valve engaged to the plate and being for selectively engaging a canister containing a cleaning solution under pressure, such that the canister is in fluidic communication with the valve;

a plurality of nozzles engaged to the first face of the plate and being operationally engaged to the valve, such that the nozzles are in fluidic communication with the valve, wherein the nozzles are configured for spraying the cleaning solution past a leading edge of the plate;

an actuator engaged to the rod proximate to a second end of the rod and being operationally engaged to the valve, such that the actuator is positioned for selectively actuating the valve for dispensing the cleaning solution through the nozzles onto a substantially vertical surface proximate to the leading edge of the plate;

a bracket engaged to the first face of the plate and being configured for engaging the canister, such that the canister is removably engaged to the plate and operationally engaged to the valve; and wherein the bracket comprises:

a housing, the valve being positioned in the housing;

a pair of first slats engaged to and extending in parallel from the housing, the first slats being engaged to the plate and being parallel to the leading edge of the plate, the nozzles being engaged to a respective first slat positioned proximate to the leading edge of the plate; and a second slat engaged to and extending between the first slats distal from the plate, such that the first slats, the second slat, and the plate define a cavity configured for insertion of the canister.

9. A surface cleaning device comprising:

a rod, the rod comprising a plurality of nested sections, such that the rod is selectively extensible, the plurality of nested sections comprising a first section and a second section, the first section being selectively extensible from the second section, the rod being tubular;

a plate pivotally engaged to a first end of the rod, such that the rod extends from a first face of the plate, the plate having a second face for selectively engaging a pad, such that the pad is removably engaged to the plate;

a connector engaged to and extending between the rod and the plate, the connector being resiliently flexible, such that the plate is pivotable relative to the rod, the connector comprising one or more of rubber, silicone, and elastomer;

a valve engaged to the plate and selectively engaging a canister containing a cleaning solution under pressure, such that the canister is in fluidic communication with the valve, the valve being air actuated;

a bracket engaged to the first face of the plate and engaging the canister, such that the canister is removably engaged to the plate and operationally engaged to the valve, the bracket comprising:

a housing, the valve being positioned in the housing, a pair of first slats engaged to and extending in parallel from the housing, the first slats being engaged to the plate and being parallel to a leading edge of the plate, and a second slat engaged to and extending between the first slats distal from the plate, such that the first slats, the second slat, and the plate define a cavity configured for insertion of the canister;

a plurality of nozzles engaged to the first face of the plate and being operationally engaged to the valve, such that the nozzles are in fluidic communication with the valve, wherein the nozzles are configured for spraying the cleaning solution past a leading edge of the plate, the plurality of nozzles comprising four nozzles, the nozzles being engaged to a respective first slat positioned proximate to the leading edge of the plate; and an actuator engaged to the rod proximate to a second end of the rod and being operationally engaged to the valve, such that the actuator is positioned for selectively actuating the valve for dispensing the cleaning solution through the nozzles onto a substantially vertical surface proximate to the leading edge of the plate, the actuator comprising:

a piston positioned in the rod proximate to the second end, a tube engaged to and extending between the piston and the valve, such that the piston is operationally engaged to the valve, and a trigger hingedly engaged to the rod proximate to the second end and being operationally engaged to the piston, wherein the trigger is configured for hinging for increasing a pressure within the tube for actuating the valve for dispensing the cleaning solution through the nozzles onto the substantially vertical surface proximate to the leading edge of the plate.

* * * * *